US009580988B2

(12) United States Patent
Bleck et al.

(10) Patent No.: US 9,580,988 B2
(45) Date of Patent: Feb. 28, 2017

(54) VARIABLE RAM PACKER WITH STRAIN REDUCTION FEATURES

(71) Applicant: Hydril USA Distribution LLC, Houston, TX (US)

(72) Inventors: Julia Anne Bleck, Houston, TX (US); Aaron John Mashue, Houston, TX (US); Joseph Alan Incavo, Houston, TX (US); Wayne Harvey, Houston, TX (US); Deepak Trivedi, Niskayuna, NY (US)

(73) Assignee: HYDRIL USA DISTRIBUTION LLC, Houston, TX (US)

( * ) Notice: Subject to any disclaimer, the term of this patent is extended or adjusted under 35 U.S.C. 154(b) by 0 days.

(21) Appl. No.: 14/962,781

(22) Filed: Dec. 8, 2015

(65) Prior Publication Data

US 2016/0160599 A1 Jun. 9, 2016

Related U.S. Application Data

(60) Provisional application No. 62/089,642, filed on Dec. 9, 2014.

(51) Int. Cl.
*E21B 33/06* (2006.01)

(52) U.S. Cl.
CPC ..... *E21B 33/061* (2013.01); *E21B 33/062* (2013.01)

(58) Field of Classification Search
CPC ..... E21B 33/062; E21B 33/061; E21B 33/06; E21B 33/085; E21B 33/04; B29C 70/68; B29C 70/04; F16K 7/00
See application file for complete search history.

(56) References Cited

U.S. PATENT DOCUMENTS 3,572,627 A * 3/1971 Jones ..... E21B 33/06 251/1.2
3,915,424 A * 10/1975 LeRouax ..... F16J 15/26 251/1.1
4,098,516 A 7/1978 Murman
4,332,367 A * 6/1982 Nelson ..... E21B 33/062 251/1.3
4,444,404 A * 4/1984 Parks, Jr. ..... E21B 33/062 251/1.2
4,461,448 A * 7/1984 Huey ..... E21B 33/06 251/1.2

(Continued)

FOREIGN PATENT DOCUMENTS

WO 2014105629 A2 7/2014

OTHER PUBLICATIONS

PCT Search Report and Written Opinion issued in connection with corresponding PCT Application No. PCT/US15/64665 on Mar. 24, 2016.

*Primary Examiner* — Kristina Fulton
*Assistant Examiner* — Eugene G Byrd
(74) *Attorney, Agent, or Firm* — Hogan Lovells US LLP

(57) ABSTRACT

A variable ram packer has an elastomeric body having a central semi-cylindrical recess and wings extending from opposite lateral sides of the recess. Inserts are positioned around the recess, each having an upper plate, a lower plate and a web joining the plates. Inserts at the junction with the wings have barrier plates between and parallel with the upper and lower plates. Upper and lower wing plates are located on upper and lower surfaces of the wings. An adhesive layer on an outer portion of each of the wing plates bonds the wing plates to the elastomer of the body. Each wing plate has an inner portion in abutment with the elastomer and free of the adhesive layer.

20 Claims, 5 Drawing Sheets

(56) References Cited

U.S. PATENT DOCUMENTS

| | | | | |
|---|---|---|---|---|
| 5,127,623 | A * | 7/1992 | McDugle | E21B 33/062 251/1.3 |
| 5,294,088 | A | 3/1994 | McWhorter et al. | |
| 5,851,013 | A | 12/1998 | Simons | |
| 5,944,110 | A | 8/1999 | Watts | |
| 6,089,526 | A | 7/2000 | Olson | |
| 6,367,804 | B1 * | 4/2002 | Watts | E21B 33/062 251/1.2 |
| 6,955,357 | B2 * | 10/2005 | Griffin | E21B 33/062 251/1.2 |
| 7,736,556 | B2 * | 6/2010 | Butuc | B29C 35/0222 264/40.6 |
| 8,540,017 | B2 * | 9/2013 | Ensley | E21B 33/062 166/84.4 |
| 8,727,303 | B2 | 5/2014 | Araujo | |
| 8,978,751 | B2 * | 3/2015 | Castriotta | E21B 33/062 166/364 |
| 9,441,443 | B2 * | 9/2016 | Cantlon | E21B 33/062 |
| 2004/0021269 | A1 * | 2/2004 | Gaudette | E21B 33/062 277/325 |
| 2004/0079909 | A1 | 4/2004 | Foster | |
| 2004/0164494 | A1 * | 8/2004 | Araujo | E21B 33/062 277/322 |
| 2010/0243926 | A1 * | 9/2010 | Weir | E21B 33/062 251/1.3 |
| 2010/0294482 | A1 * | 11/2010 | Araujo | E21B 33/061 166/85.4 |
| 2014/0183381 | A1 * | 7/2014 | Carbaugh | E21B 33/062 251/1.1 |
| 2014/0183382 | A1 | 7/2014 | Carbaugh | |

* cited by examiner

VARIABLE RAM PACKER WITH STRAIN REDUCTION FEATURES

CROSS REFERENCE TO RELATED APPLICATION

This application claims priority to provisional patent application Ser. No. 62/089,642, filed Dec. 9, 2014.

FIELD OF INVENTION

This invention relates in general to oil and gas equipment, and in particular to variable ram packers for use in blowout preventers.

BACKGROUND

During oil and gas well drilling and workover operations, precautions must be taken to prevent high pressure from the earth formations from escaping. Blowout preventer assemblies often include pipe rams, each having a packer element within. When the rams are brought together, the force causes the elastomer in the packers to seal around the pipe.

Some rams are configured to seal around a particular diameter of pipe. Others are variable in inner diameter in order to seal around a range of pipe diameter sizes. A typical variable ram packer has a central elastomeric body with a semi-cylindrical recess for receiving a pipe. Wings may extend radially outward from the central body. Each wing has a flat face that abuts against the flat face of one of the wings of the packer in the other ram.

Metal inserts embedded in the elastomer extend around the cylindrical recess. Each insert typically has upper and lower plates joined by a web. Metal wing top plates bond to the upper side of each wing, and metal wing bottom plates bond to the lower side of each wing. In the prior art, the portion of each top and bottom wing plate in contact with the elastomer of the wing bonds to the elastomer. The bonding is caused by applying adhesive coatings to these surfaces before placing the top and bottom wing plates in the mold.

As the packers seal around a pipe, the elastomer deforms and the inserts move. The bonding of the top and bottom wing plates can cause considerable strain in the elastomer as the bonded portions are not free to move relative to the top and bottom wing plates.

Also, strain occurs to the wing faces after sealing engagement. The high pressure differential of the well bore fluid being sealed can tend to break down the elastomer at the wing faces. High temperatures can increase the break down. The well bore fluid being sealed tends to flow upward from the lower to the upper side of the packers if the pressure is higher below.

SUMMARY

A variable ram packer has a body formed of an elastomer and having a central portion with an upper surface, a lower surface, and a central semi-cylindrical recess for sealing around a pipe. Wings extend from opposite lateral sides of the recess. Each of the wings has an upper surface and a lower surface with a face extending between. Multiple inserts are embedded within the central portion of the body and positioned around the recess. Each of the inserts has an upper plate at the upper surface of the central portion of the body, a lower plate at the lower surface of the central portion of the body and a web joining the upper and lower plates. An upper wing plate is on the upper surface of each of the wings, and a lower wing plate is on the lower surface of each of the wings. Each of the upper and lower wing plates has an inner edge overlapping one of the inserts and an outer edge. Each of the wing plates has an abutting surface extending inward from the outer edge and in abutment with a portion of the elastomer of the body extending outward from one of the plates of one of the inserts. An adhesive layer on an outer portion of each of the abutting surfaces bonds each of the upper and lower wing plates to the elastomer of the body. Each of the abutting surfaces has an inner portion free of the adhesive layer.

The adhesive layer on each of the abutting surfaces of the upper and lower wing plates has a radial length less than one-half a radial length of each of the upper and lower wing plates from the outer edge to the inner edge.

In one embodiment, each of the wings has an inner portion that joins the central portion of the body and an inclined section extending outward and upward from the inner portion. The outer edge of the abutting surface of each of the upper and lower wing plates is at an angle relative to the inner portion of each of the abutting surfaces. The outer portion that contains the adhesive layer is located only at the outer edge of each of the upper and lower wing plates.

In one embodiment, an upper inclined section plate is on an upper surface of each of the inclined sections, and a lower inclined section plate is on a lower surface of each of the inclined sections. An inner edge of each of the upper inclined section plates and the outer edge of one of the upper wing plates has a notch and tab engaging arrangement. An inner edge of each of the lower inclined section plates and the outer edge of one of the lower wing plates has a notch and tab engaging arrangement. Each of the adhesive layers is located at the notch and tab engaging arrangement of the upper and lower wing plates.

The inserts include a wing insert located at each junction of the curved recess with one of the wings. In one embodiment, a barrier plate joins the web of each of the wing inserts between and parallel with the upper and lower plates of each of the wing inserts. Each of the barrier plates has a face edge that is substantially flush with the face of one of the wings. Each of the barrier plates has a back edge spaced farther from the face of the wing than any back portion of either of the plates of the wing insert. Each of the barrier plates has an outer edge spaced farther from the recess than any portion of either of the wing inserts.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

Figure 1:
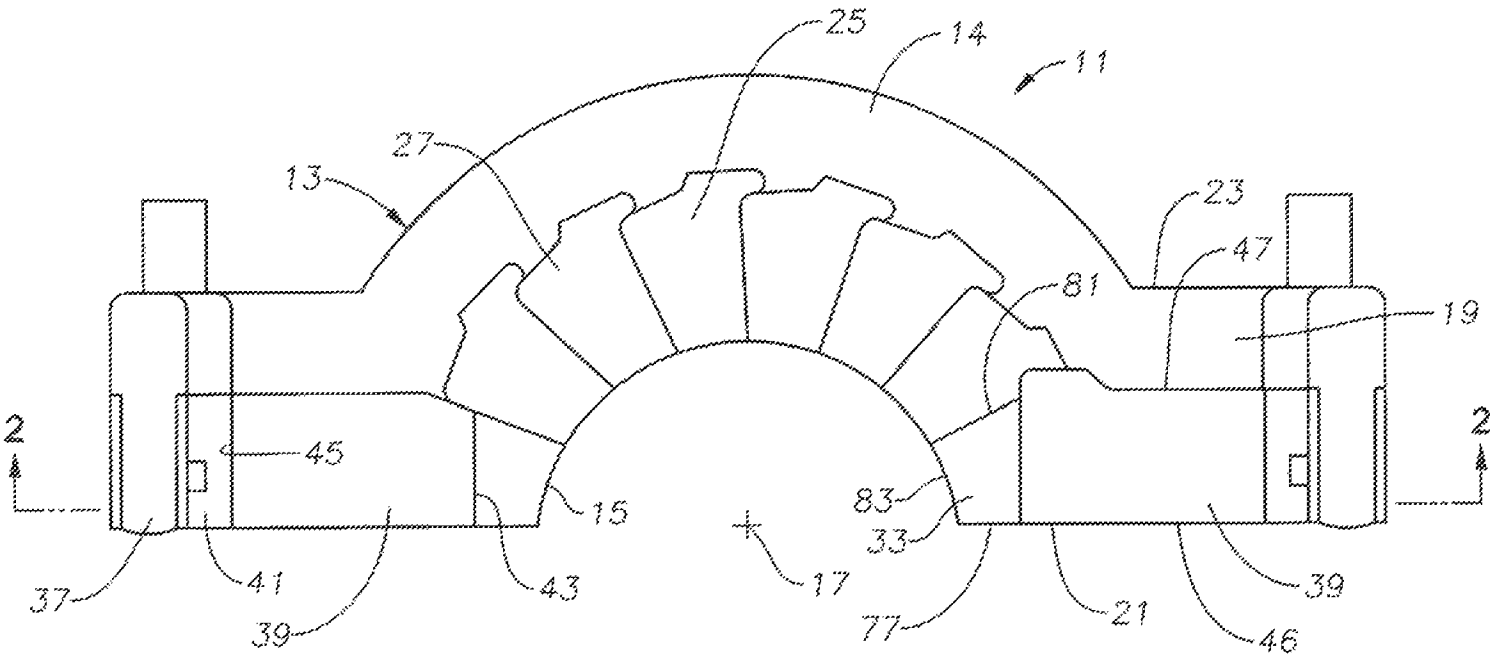
FIG. 1 is a simplified top view of a variable ram packer in accordance with this disclosure.

Referring to FIG. 1, variable ram packer 11 locates within a pocket in a conventional ram (not shown). Variable ram packer 11 has an elastomeric body 13, typically a rubber that is deformable but not compressible. Elastomeric body 13 has a central portion 14 with a semi-cylindrical recess 15 having an axis 17. The back side of elastomeric body 13 may also be curved, and is shown at a different curvature than recess 15.

Elastomeric body 13 has a pair of wings 19, each joining central portion 14 extending laterally outward relative to axis 17. Both the left-hand and right-hand wings 19 are referred to by the same numeral. Each wing 19 has a flat wing face 21 that are located in an axial radial plane. Wing faces 21 join recess 15 and are located in a common plane. Each wing 19 has a back side 23 that may be parallel with wing faces 21.

Figure 2:
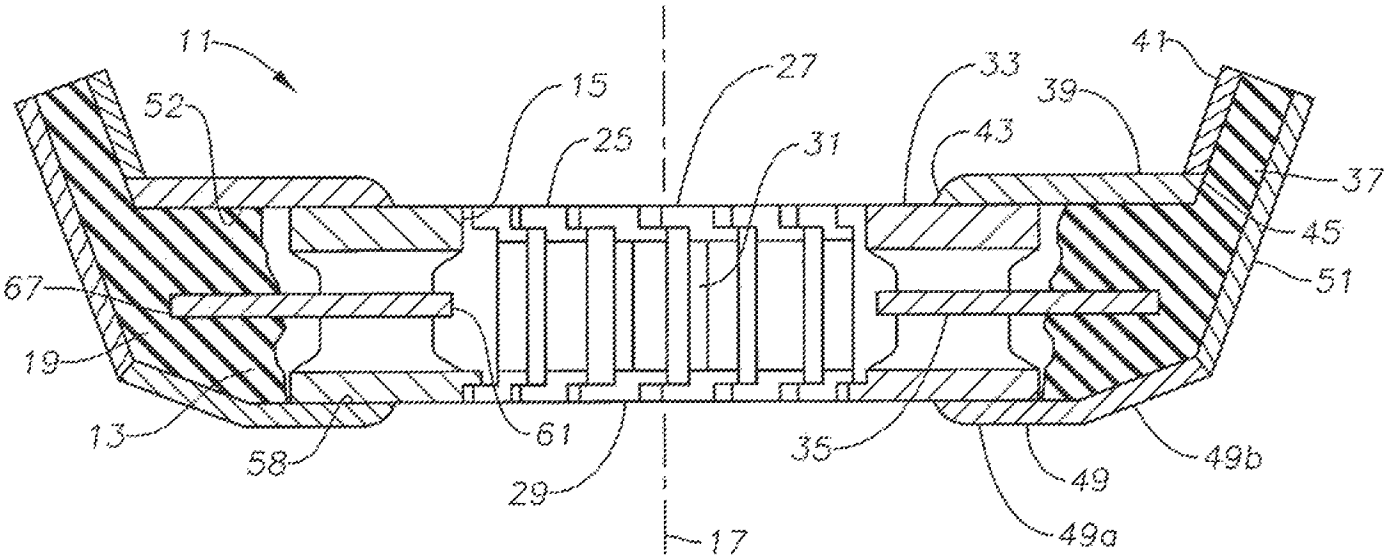
FIG. 2 is a partial sectional view of the variable ram packer of FIG. 1, taken along a line 2-2 of FIG. 1.

Inserts 25 are embedded in the elastomeric material of elastomeric body 13 around recess 15. Inserts 25 are identical to each other and are formed of a rigid material, such as a metal. As shown in FIG. 2, each insert 25 has an upper plate 27 and a lower plate 29 joined by a web 31. Part of the elastomer of body 13 has been removed from FIG. 2 for clarity. Upper plates 27 of adjacent inserts 25 overlap with each other, and lower plates 29 of inserts 25 overlap with each other. Upper plates 27 are flush with the upper side of elastomeric body central portion 14. Lower plates 29 are flush with the lower side of elastomeric body central portion 14. When the ram brings variable ram packer 11 into abutment with a variable ram packer 11 of another ram, inserts 25 move relative to each other to allow the elastomer of body 13 to conform to the pipe (not shown) located in the mating recesses 15 of the abutting packers 11.

Two of the inserts 25 are located at the junction with each wing face 21 and recess 15. These two inserts 25, referred to herein as wing inserts 33, are identical to the other inserts 25, except that each may have a barrier plate 35. As described in more detail below, each barrier plate 35 is in a plane parallel with planes of insert upper plates 27 and lower plates 29. Each barrier plate 35 is located approximately equidistant between upper and lower plates 27,29. Barrier plates 35 are mounted to only the wing inserts 33, not the other inserts 25.

Referring still to FIG. 2, in this example, each wing 19 has an elastomeric inclined section 37 that extends upward and outward relative to the inner portion of each wing 19. A wing top plate 39 mounts on the upper surface of the inner portion of each wing 19. Wing top plate 39 is flat and located in a common plane with the upper side of elastomeric body central portion 14. A wing top inclined plate 41 abuts wing top plate 39 and extends along the upper side of wing inclined section 37. Each wing top plate 39 has an inner edge 43 that overlaps part of the upper plate 27 of one of the wing inserts 33. Wing top plate inner edge 43 may be straight and is spaced radially outward from recess 15. Wing top plates 39 are not fastened to the upper plates 27 of any of the inserts 25, including wing inserts 33, allowing some relative movement.

Each wing top plate 39 has an outer edge 45 at the inner edge of wing inclined section 37. Wing top plate outer edge 45 abuts the inner edge of wing top inclined plate 41. Referring again to FIG. 1, each wing top plate 39 has a face edge 46 that is flush with wing face 21. Each wing top plate 39 has a back edge 47 that is forward of wing back side 23 and parallel with wing face 21. Each wing top plate 39 is generally rectangular; however, the wing top plate 39 on the right-hand wing 19, as shown in FIGS. 1 and 2, may differ in shape from the wing top plate 39 on the left-hand wing 19. The wing top plate 39 on the right-hand side has a wider inner edge 43 than outer edge 45. The wing top plate 39 on the left-hand side has a wider outer edge 45 than inner edge 43.

Referring again to FIG. 2, a wing bottom plate 49 mounts on the lower surface of each wing 19. Wing bottom plate 49 has an inner portion 49*a* and an outer portion 49*b* that are flat but at an obtuse angle relative to each other. Inner portion 49*a* is in a common plane with the lower surface of body central portion 14 and the inner portion of wing 19. Bottom wing plate outer portion 49*b* is in a common plane with the lower surface of an inner portion of wing inclined section 37. A wing bottom inclined plate 51 is located on the lower side of each wing inclined section 37. An inner edge of wing bottom inclined plate 51 abuts an outer edge of wing bottom plate 49.

Figure 4:
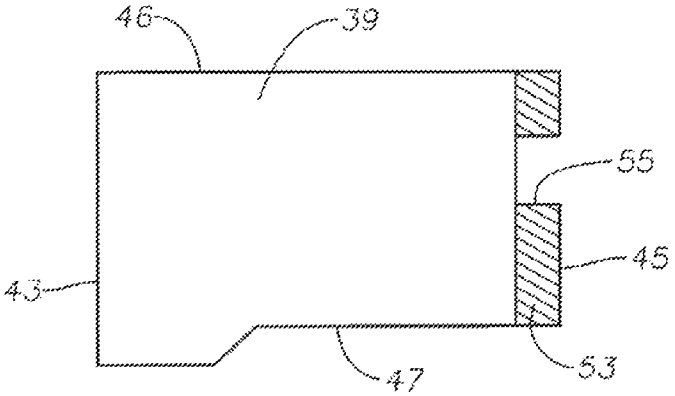
FIG. 4 is a lower side view of the right-hand upper wing plate of FIG. 3, schematically illustrating an area containing adhesive.
Figure 3:
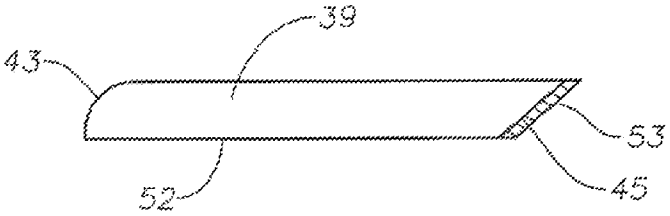
FIG. 3 is a side view of a right-hand upper wing plate of the variable ram packer of FIG. 1, shown removed from the variable ram packer.

FIG. 3 is an enlarged side view of the right-hand side wing top plate 39, shown removed from packer 11. Outer edge 45 is inclined in this embodiment relative to the remaining portion of a lower side 52 of wing top plate 39 and is considered herein to be a part of lower side 52. Referring back to FIG. 2, a portion of lower side 52 will overlie part of wing insert 33, while the remaining portion of lower side 52 is in abutment with the elastomer of body 13. Referring again to FIG. 3 and also FIG. 4, a layer of adhesive 53 (the thickness is exaggerated) will be coated on inclined outer edge 45 prior to the molding of packer body 13. In this example, adhesive layer 53 is located only on the inclined outer edge 45, with the remaining portion of lower side 52 being uncoated. FIG. 4 shows lower side 52 and the strip of adhesive 53, which extends from face edge 46 to back edge 47 of wing top plate 39. In this embodiment, the radial width of adhesive coated portion 53 is the same as the width of inclined outer edge 45, measured along a radial line of axis 17 (FIG. 1). The radial width of adhesive coated portion 53 is much less than one-half the radial length of wing top plate lower side 52 measured along a radial line of axis 17 (FIG. 1) from inner edge 43 to the outer border of inclined outer edge 45. In this example, the radial width of adhesive layer 53 is only about 10 percent of the radial length of wing top plate 39 from outer edge 45 to inner edge 43. Adhesive coating 53 will be in direct bonded contact with the upper side of the elastomer of a portion of wing 19 (FIG. 2).

Adhesive coating 53 will cause wing top plate 39 to adhere to the elastomer in only a small part of the upper portion of wing 19 outward from wing insert upper plate 27 (FIG. 2). The portion of the elastomer between wing insert upper plate 27 and adhesive 53 is free to move relative to the uncoated portions of the lower side 52 of wing top plate 39. The freedom of movement reduces strain that might otherwise occur while packer 11 is being sealed around a pipe. The left-hand wing top plate 39 has an identical adhesive coating 53 at the outer edge 45 and no adhesive coating on remaining portion of the lower side 52.

In this embodiment, a notch 55 (FIG. 4) is formed in wing top plate outer edge 45 for receiving a tab (not shown) of wing top inclined plate 41 (FIG. 2). Adhesive coating 53 may have a width equal to the depth of notch 55. The notch 55 and tab arrangement positions top inclined plate 41 and wing top plate 39 relative to each other, but does not rigidly connect them.

Figure 5:
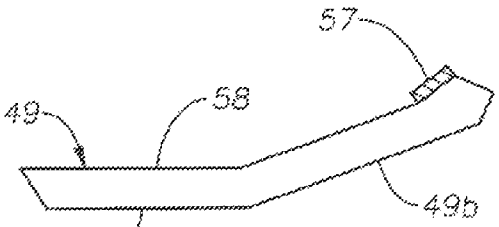
FIG. 5 is a side view of a right-hand lower wing plate of the variable ram packer of FIG. 1, shown removed from the variable ram packer.

FIG. 5 shows an enlarged side view of the right-hand wing bottom plate 49 removed from packer 11. Wing bottom plate 49 has a similar adhesive coating 57 (greatly exaggerated in thickness) adjacent its outer edge. Wing bottom plate 49 has an upper side 58 that is free of adhesive, other than adhesive coating 57, and in abutting contact with a lower side of the elastomer of wing 19. The portion of the lower side of the elastomer of wing 19 from wing insert lower plate 29 (FIG. 2) to adhesive 57 is not bonded to lower plate 49 and is free to flex, reducing strain.

Figure 6:
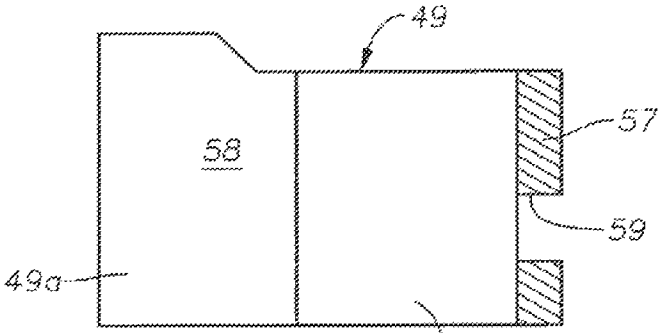
FIG. 6 is an upper side view of the right-hand lower wing plate of FIG. 5, schematically illustrating an area containing adhesive.

Referring to FIG. 6, a notch 59 is formed at the outer edge of wing bottom plate 49 for receiving a tab (not shown) of wing bottom inclined plate 51. The notch and tab arrangement positions wing bottom plate 49 and wing bottom inclined plate 51 relative to each other, but allows relative movement. The radial width of the strip of adhesive 57 is shown to be the same as the depth of notch 59 in FIG. 6. The radial width of the strip of adhesive 57 is much less than one-half the length of wing bottom plate 49 from its inner to its outer edge, and is illustrated to be about 10 percent.

During manufacturing, adhesive coatings are conventionally applied to portions of the inserts 25, 33 and wing inclined plates 41, 51. Adhesive coatings 53, 57 are applied to wing plates 39, 49 as described. The various inserts 25, 33 and wing plates 39, 41, 49 and 51 are placed in a mold and an elastomer is injected under high pressure. Packer 11 is removed from the mold after curing.

When packers 11 are installed in rams, and the rams are moved together to seal around a pipe, the elastomer stretches and deforms to meet the faces of the pipe. The large area of elastomer of body 13 that is located behind wing inserts 33 stretches the most. The small adhesive strips 53, 57 at the outer edges of wing plates 39, 49 allow more of the elastomer in this area to expand freely and not become overstrained. This adhesive configuration for the packer 11 allows the packer to seal at higher temperatures for a longer period of time. This means that the packer 11 has a longer life and is capable of longer periods of operation.

Figure 7:
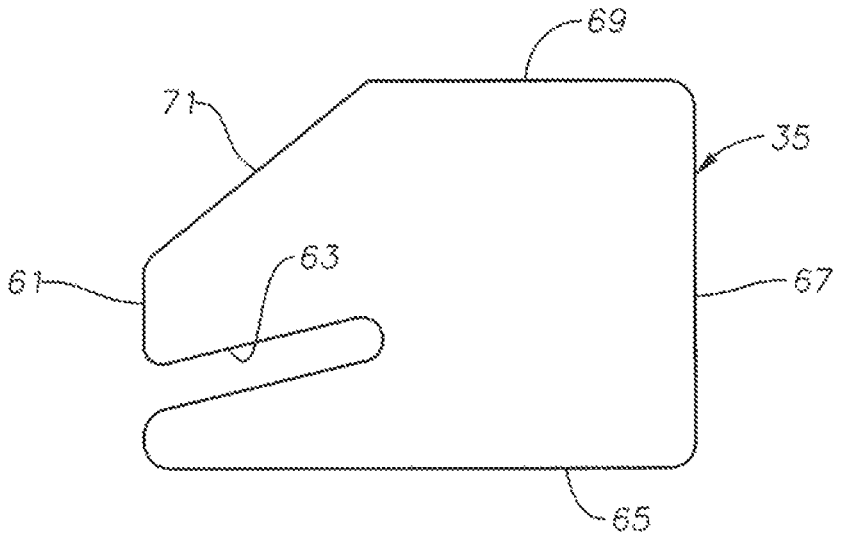
FIG. 7 is a side view of a right-hand barrier plate of the variable ram packer of FIG. 1, shown removed from the variable ram packer.

Barrier plate 35 (FIG. 2) mentioned above may be employed separately or in combination with the strain reducing adhesive coatings 53, 57. Referring to FIG. 7, the right-hand barrier plate 35 has an inner edge 61 and a slot 63 extending inward from inner edge 61. Barrier plate 35 has a face edge 65 that is flush with the plane of each wing face 21 (FIG. 1). Barrier plate 35 has an outer edge 67 and a back edge 69. Back edge 69 may be parallel with face edge 65 and perpendicular to outer edge 67. Back edge 69 has a shorter length than face edge 65, and a diagonal edge 71 extends from the inner end of back edge 69 to inner edge 61. Inner edge 61 may be parallel with outer edge 67, but has a shorter length.

Each barrier plate 35 is rigid and may be formed of metal. The left-hand barrier plate 35 (FIG. 1) is not identical to the right-hand barrier plate 35 because of its location, but it may be a mirror image. For example, it will have a diagonal edge similar to diagonal edge 71 (FIG. 7) to accommodate adjacent inserts 25; however, the diagonal edge of the left-hand barrier plate 35 will be on a reverse side. The left-hand barrier plate 35 will have a face edge similar to face edge 65 that is flush with face 21 on the left-hand wing 19.

Figure 8:
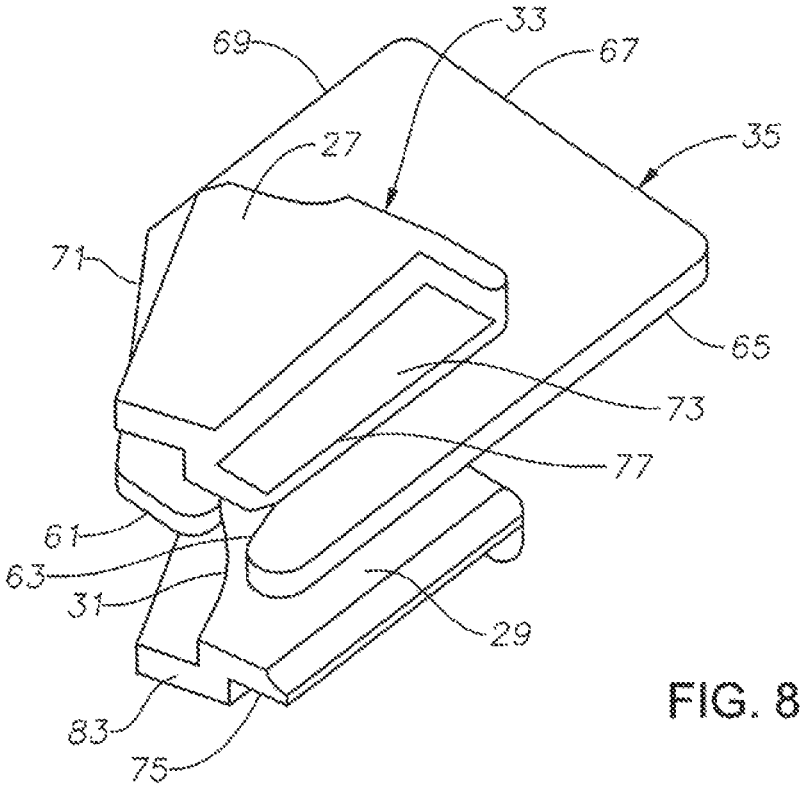
FIG. 8 is a perspective view of the right-hand barrier plate of FIG. 7 shown assembled with a right-hand wing insert.

FIG. 8 shows barrier plate 35 assembled with the right-hand wing insert 33. Slot 63 receives web 31, then barrier plate 35 may be rigidly secured to wing insert 33, such as by welding. Alternately, wing insert 33 and barrier plate 35 could be formed together as a casting.

Figure 9:
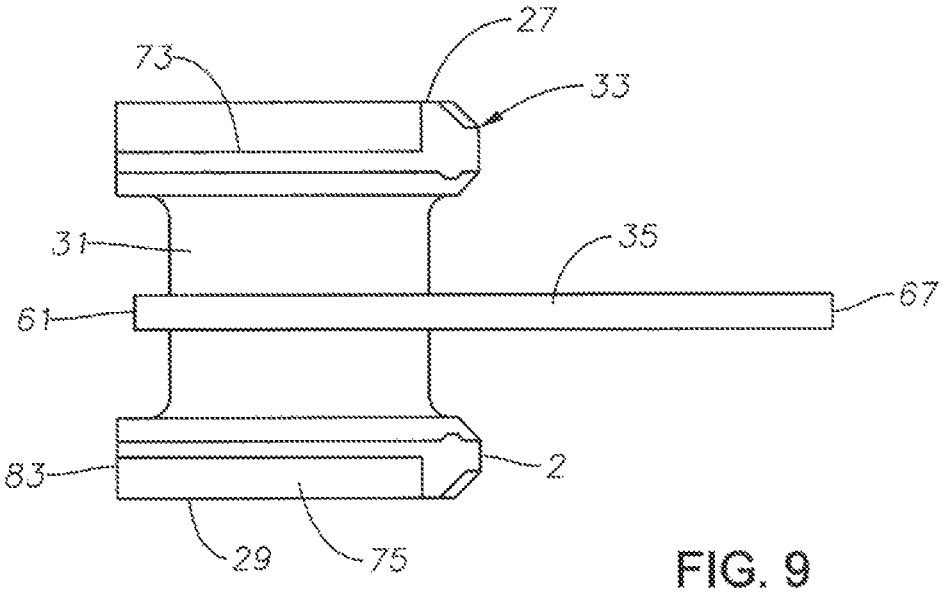
FIG. 9 is a side view of the right-hand barrier plate and the right-hand wing insert of FIG. 8.
Figure 10:
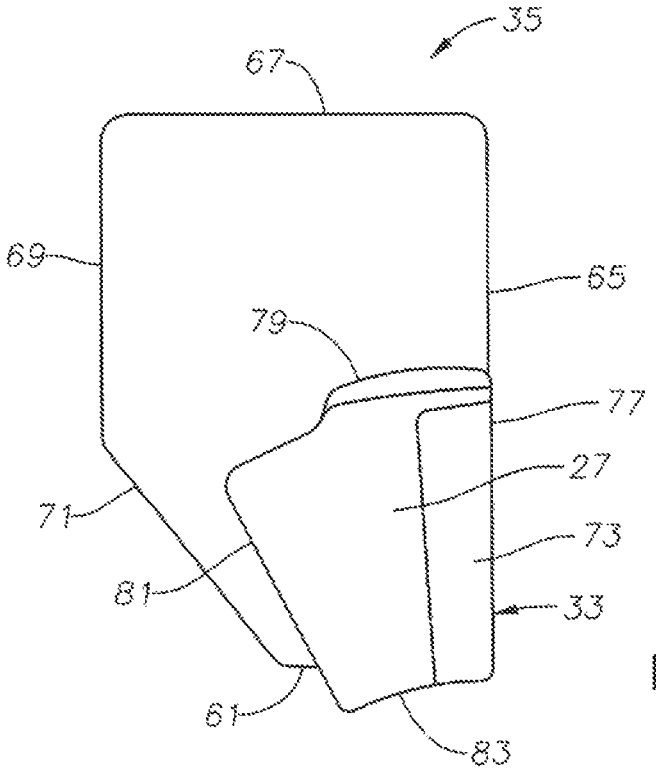
FIG. 10 is a top view of the right-hand barrier plate and the right-hand wing insert of FIG. 9.

FIGS. 8-10 show more details than FIGS. 1 and 2 of wing insert 33, which may be identical to the other inserts 25, but for barrier plate 35. Wing insert upper plate 27 has a recess 73 on its upper side, and wing insert lower plate 29 has a recess 75 on its lower side. For inserts 25 (FIG. 1), recesses 73, 75 accommodate overlapping portions of upper and lower plates 27, 29 of adjacent inserts 25. Recesses 73, 75 of the right-hand wing insert 33 are used when the two rams come together. The left-hand wing insert 33 of the opposing packer will fit into recess 73, 75. Upper and lower plates 27, 29 have face edges 77 that are flush with wing face 21 (FIG. 1). Barrier plate face edge 65 will be aligned and substantially in a common plane with upper and lower plate face edges 77.

FIG. 9 shows that barrier plate inner edge 61 may be slightly outward from the inner edges 83 of upper and lower insert plates 27, 29, which are flush with recess 15 (FIG. 1). Barrier plate outer edge 67 is considerably farther from recess 15 than the outer edges 79 of upper and lower insert plates 27, 29. Preferably, barrier plate outer edge 67 is approximately the same distance from recess 15 (FIG. 1) as wing top plate outer edge 45.

FIG. 10 shows that diagonal edge 71 is farther from face edge 65 than insert upper plate face edge 77. FIG. 10 also shows that the surface area of barrier plate 35 is much larger than the surface area of insert upper plate 27. The width of barrier plate 35 from face edge 65 to back edge 69 may be approximately the same as the width of wing top plate 39 (FIG. 1).

In operation, rams (not shown) are brought together, with wing faces 21 abutting and the rubber of body 13 at recess 15 sealing around a pipe. The sealing engagement blocks well bore fluid from below the mating packers 11 from fluid above. The barrier plates 35 create a tortuous path for any fluid that has broken down the elastomer of packer body 13 at wing faces 21 trying to move from below to above, or vice-versa. The face edges 65 of the barrier plates 35 in each packer 11 mate, forming a solid barrier for any well bore fluid that has successfully broken down the rubber at wing faces 21. As the well bore fluid encounters this solid barrier, it is forced to migrate back into the packer 11 and thus has a much longer path through the rubber body 13 before it can escape the seal created by the packers 11. Since it lakes time for the rubber to break down during exposure to well bore fluid, barrier plates 35 create a longer packer life. Barrier plates 35 also assist in maintaining the life of the packers under elevated temperatures.

It is to be understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

The invention claimed is:

1. A variable ram packer, comprising:

a body formed of an elastomer and having a central portion with an upper surface, a lower surface, a central semi-cylindrical recess for sealing around a pipe, and wings extending from opposite lateral sides of the recess, relative to an axis of the recess, each of the wings having an upper surface and a lower surface with a face extending between;

a plurality of inserts embedded within the central portion of the body and positioned around the recess, each of the inserts having an upper plate at the upper surface of the central portion of the body, a lower plate at the lower surface of the central portion of the body and a web joining the upper and lower plates;

an upper wing plate on the upper surface of each of the wings and a lower wing plate on the lower surface of each of the wings;

each of the upper and lower wing plates having an inner edge overlapping one of the inserts and an outer edge, each of the wing plates having an abutting surface extending inward from the outer edge and in abutment with a portion of the elastomer of the body extending outward from one of the plates of one of the inserts; and an adhesive layer on an outer portion of each of the abutting surfaces that bonds each of the upper and lower wing plates to the elastomer of the body, each of the abutting surfaces having an inner portion free of the adhesive layer.

2. The variable ram packer according to claim 1, wherein the adhesive layer on each of the abutting surfaces of the upper and lower wing plates has a radial length less than one-half a radial length of each of the upper and lower wing plates from the outer edge to the inner edge.

3. The variable ram packer according to claim 1, wherein:

each of the wings has an inner portion that joins the central portion of the body and an inclined section extending outward and upward from the inner portion; and the outer portion that contains the adhesive layer is located only at the outer edge of each of the upper and lower wing plates.

4. The variable ram packer according to claim 3, further comprising:

an upper inclined section plate on an upper surface of each of the inclined sections, and a lower inclined section plate on a lower surface of each of the inclined sections;

a notch and tab engaging arrangement between an inner edge of each of the upper inclined section plates and the outer edge of one of the upper wing plates;

a notch and tab engaging arrangement between an inner edge of each of the lower inclined section plates and the outer edge of one of the lower wing plates; and wherein:

each of the adhesive layers is located on the notch and tab engaging arrangement of each of the upper and lower wing plates.

5. The variable ram packer according to claim 1, wherein:

the inserts include a wing insert located at each junction of the curved recess with one of the wings; and wherein the variable ram packer further comprises:

a barrier plate that joins the web of each of the wing inserts between and parallel with the upper and lower plates of each of the wing inserts.

6. The variable ram packer according to claim 5, wherein:

each of the barrier plates has a face edge that is substantially flush with the face of one of the wings.

7. The variable ram packer according to claim 6, wherein:

each of the barrier plates has a back edge spaced farther from the face of the wing than any back portion of either of the plates of the wing insert.

8. The variable ram packer according to claim 5, wherein each of the barrier plates has an upper surface with a greater surface area than an upper surface of the upper plate of the wing insert to which it is joined.

9. The variable ram packer according to claim 5, wherein:

each of the barrier plates has an outer edge spaced farther from the recess than any portion of either of the wing inserts.

10. A variable ram packer, comprising:

a body formed of an elastomer, the body having a central semi-cylindrical recess for sealing around a pipe and wings extending from opposite lateral sides of the recess, relative to an axis of the recess, each of the wings having a flat face located in a radial plane;

a plurality of inserts embedded within the body around the recess, each of the inserts having an upper plate, a lower plate and a web joining the upper and lower plates;

the inserts including a wing insert at a junction of the recess with each of the wings, the upper and lower plates of each of the wing inserts having face edges located substantially in a common plane with the face of each of the wings; and a barrier plate that joins the web of each of the wing inserts between and parallel with the upper and lower plates of each of the wing inserts, each of the barrier plates being embedded within the elastomer of the body.

11. The variable ram packer according to claim 10, wherein:

each of the barrier plates has a face edge that is flush with the face of one of the wings.

12. The variable ram packer according to claim 10, wherein:

each of the barrier plates has a back edge spaced farther from the face of the wing in which each of the barrier plates is located than any back portion of either of the plates of the wing insert to which each of the barrier plates is joined.

13. The variable ram packer according to claim 10, wherein:

each of the barrier plates has an outer edge spaced radially farther from the recess than any portion of either of the wing inserts.

14. The variable ram packer according to claim 10, wherein:

each of the barrier plates has a slot that receives the web of one of the wing inserts.

15. The variable ram packer according to claim 10, wherein each of the barrier plates is located substantially equidistant between the upper and lower plates of one of the wing inserts.

16. The variable ram packer according to claim 10, wherein each of the barrier plates has an upper surface with a greater surface area than an upper surface of the upper plate of the wing insert to which it is joined.

17. A variable ram packer, comprising:

a body formed of an elastomer having a central semi-cylindrical recess for sealing around a pipe, the body having wings extending from opposite lateral sides of the recess, relative to an axis of the recess, each of the wings having an upper surface and a lower surface joined by a flat face located in a radial plane;

a plurality of inserts embedded within the elastomer of the body and positioned around the recess, each of the inserts having an upper plate at an upper surface of the body, a lower plate at a lower surface of the body and a web joining the upper and lower plates;

the plurality of inserts including a wing insert at a junction of the recess with the face of each of the wings, the upper and lower plates of each of the wing inserts having face edges located substantially in a common plane with the face of one of the wings;

each of the wing inserts having a barrier plate joining the web of each of the wing inserts between and parallel with the upper and lower plates of each of the wing inserts;

an upper wing plate on an upper surface of each of the wings and a lower wing plate on a lower surface of each of the wings;

each of the upper and lower wing plates having an inner edge overlapping one of the wing inserts and an outer edge, each of the wing plates having an abutting surface extending inward from the outer edge and in abutment with a portion of the elastomer of the body extending outward from one of the plates of one of the wing inserts; and an adhesive layer on an outer portion of each of the abutting surfaces that bonds each of the upper and lower wing plates to the elastomer of the body, each of the abutting surfaces having an inner portion free of the adhesive layer.

18. The variable ram packer according to claim 17, wherein:

each of the barrier plates has a face edge that is flush with the face of one of the wings.

19. The variable ram packer according to claim 17, wherein each of the barrier plates has an upper surface with a greater surface area than an upper surface of the upper plate of the wing insert to which it is joined.

20. The variable ram packer according to claim 17, wherein the adhesive layer on each of the abutting surfaces of the upper and lower wing plates has a radial length less than one-half a radial length of each of the upper and lower wing plates from the outer edge to the inner edge.

* * * * *